US007515507B2

(12) United States Patent
Nanda

(10) Patent No.: US 7,515,507 B2
(45) Date of Patent: Apr. 7, 2009

(54) BOTTLE FOR DENTAL HYGIENE PRODUCT WITH TIMING MECHANISM

(75) Inventor: Puneet Nanda, Cerritos, CA (US)

(73) Assignee: Growmax Investments Limited, Tortola BR (VG)

( * ) Notice: Subject to any disclaimer, the term of this patent is extended or adjusted under 35 U.S.C. 154(b) by 159 days.

(21) Appl. No.: 11/407,820

(22) Filed: Apr. 20, 2006

(65) Prior Publication Data

US 2006/0238338 A1 Oct. 26, 2006

Related U.S. Application Data

(60) Provisional application No. 60/673,681, filed on Apr. 20, 2005.

(51) Int. Cl.
*G04B 47/00* (2006.01)

(52) U.S. Cl. ..... 368/10; 388/327; 222/30; 215/230

(58) Field of Classification Search ..... 368/10; 248/114–116; 222/30; 215/230
See application file for complete search history.

(56) References Cited

U.S. PATENT DOCUMENTS

| | | | | |
|---|---|---|---|---|
| 2,108,692 | A | 5/1938 | Pieck | |
| 3,783,364 | A | 1/1974 | Gallanis et al. | |
| 3,894,550 | A | 7/1975 | Eaton | |
| 4,054,026 | A | 10/1977 | Goodrich | |
| 4,361,408 | A | 11/1982 | Wirtschafter | |
| 4,419,016 | A | 12/1983 | Zoltan | |
| 4,448,541 | A | 5/1984 | Wirtschafter | |
| 4,450,599 | A | 5/1984 | Scheller et al. | |
| 4,836,415 | A | 6/1989 | Grussmark | |
| 4,974,423 | A | 12/1990 | Pring | |
| 4,991,755 | A | 2/1991 | Grusmark | |
| 5,118,355 | A | 6/1992 | Browning | |
| 5,135,485 | A | 8/1992 | Cohen et al. | |
| 5,154,917 | A | 10/1992 | Ibrahim et al. | |
| 5,313,439 | A | 5/1994 | Albeck | |
| 5,438,726 | A | 8/1995 | Leite | |
| 5,457,665 | A * | 10/1995 | Reid | 368/93 |
| 5,629,527 | A | 5/1997 | Levitt et al. | |
| D379,767 | S | 6/1997 | Rowley | |
| 5,746,348 | A | 5/1998 | Bloom | |

(Continued)

FOREIGN PATENT DOCUMENTS

| | | |
|---|---|---|
| WO | WO 96/14025 | 5/1996 |

OTHER PUBLICATIONS

Biotene :: laclede.com/products/mouthwash.asp; Dec. 31, 2004.*

(Continued)

*Primary Examiner*—Vit W Miska
*Assistant Examiner*—Sean Kayes
(74) *Attorney, Agent, or Firm*—Knobbe, Martens, Olson & Bear LLP

(57) ABSTRACT

A packaging system includes a bottle that holds a dental hygiene product. A closure is configured to be removably coupled to the bottle. The bottle defines an opening when the closure is removed from the bottle. The timing mechanism is coupled to at least one of the bottle and closure. The timing mechanism includes a sensory device and a timer. The timing mechanism measures a time period and provides an output after a preset period of time has elapsed.

14 Claims, 6 Drawing Sheets

U.S. PATENT DOCUMENTS

| | | | | |
|---|---|---|---|---|
| 5,751,661 | A | 5/1998 | Walters | |
| 5,960,507 | A | 10/1999 | Dutra et al. | |
| 6,029,303 | A | 2/2000 | Dewan | |
| 6,037,872 | A | 3/2000 | Dunnum | |
| 6,081,957 | A | 7/2000 | Webb | |
| 6,084,504 | A | 7/2000 | Rosche et al. | |
| 6,098,497 | A * | 8/2000 | Larose | 81/3.4 |
| 6,299,770 | B1 | 10/2001 | Diener et al. | |
| 6,317,390 | B1 | 11/2001 | Cardoza | |
| 6,409,046 | B1 * | 6/2002 | Peckels | 222/1 |
| 6,588,593 | B2 * | 7/2003 | Woskoski | 206/459.1 |
| 7,017,408 | B2 * | 3/2006 | Ramus et al. | 73/293 |
| 7,293,458 | B2 * | 11/2007 | Ramus et al. | 73/304 R |

OTHER PUBLICATIONS

Act Dental Rinse :: ://hocks.com/hocks_com_on_line_pharmacy/2546877.html; Nov. 12, 2004.*

International Search Report for Application No. PCT/US06/14951 (the PCT counterpart of the parent application) mailed Jul. 27, 2007.

* cited by examiner

BOTTLE FOR DENTAL HYGIENE PRODUCT WITH TIMING MECHANISM

PRIORITY INFORMATION

This application claims the priority benefit under 35 U.S.C. §119(e) of Provisional Application 60/673,681, filed Apr. 20, 2005, the entire contents of which are hereby incorporated by reference herein.

BACKGROUND OF THE INVENTIONS

1. Field of the Inventions

These inventions relate in general to consumer products and, particularly, to packaging for containing dental hygiene product with a timing mechanism.

2. Description of the Related Art

Oral care products, such as dental hygiene products, are used to clean teeth, destroy harmful microorganisms found in the mouth, reduce unpleasant mouth odors, and the like. A person's mouth may harbor many types of unwanted microorganisms, such as bacteria. These microorganisms contribute to both the initiation and progression of gingivitis, plaque build up, periodontal disease, and/or breath malodor. Dental hygiene products can be used to kill these microorganisms, loosen or removed plaque, and reduce breath malodor.

For example, mouthwash containing antibacterial agents may be employed to treat a person's mouth. The efficacy of mouthwash may depend on the duration of time that a person uses or "rinses" with the mouthwash. Unfortunately, mouthwash often has an unpleasant taste and smell, which are attributable to its antibacterial agents. To increase the number of microorganisms destroyed during the rinsing process, a person may have to rinse with a particular mouthwash for an optimum amount of time, which may depend on the chemical composition of the mouthwash. People may not rinse with mouthwash for a suitable amount of time for destroying a desirable number of microorganisms.

SUMMARY OF THE INVENTION

In some embodiments, a packaging system includes a closure and a container. The container is configured to receive the closure and is designed to hold foodstuffs, dental hygiene products, or medicants. The dental hygiene products can be mouthwash, rinsing solutions, or other antibacterial agents or liquids. At least one of the closure and the container comprises a timing mechanism that can provide feedback to a person that uses the mouthwash from the container. The timing mechanism can be used to inform a person how long they have rinsed their mouth with mouthwash. Thus, a person does not have use a separate clock or watch to determine when they have rinsed for a suitable length of time.

In some embodiments, a packaging system comprises a bottle that holds a dental hygiene product. A closure is configured to be removably coupled to the bottle. The bottle defines an opening when the closure is removed from the bottle. The timing mechanism is coupled to at least one of the bottle and closure. The timing mechanism includes a sensory device and a timer. The timing mechanism measures a time period and provides an output after a preset period of time has elapsed.

In some embodiments, the sensory device is positioned within a wall of the closure. In one embodiment, the packaging system further comprises one ore more sensors positioned on the closure configured to detect the presence of a liquid within the closure. The timing mechanism is configured to activate when said sensor detects a liquid within the closure. In yet another embodiment, the sensor is a configured to detect the presence of a liquid within the closure when a liquid physically contacts the sensor.

In some embodiments of using a dental hygiene product, a cap is removed from a bottle in which the dental hygiene product is stored. The dental hygiene product is poured into a cap to activate a timing mechanism provided within or on the cap. The dental hygiene product is transferred from the cap to a user's mouth. The dental hygiene product is used for a period of time that is indicated by the timing mechanism.

DETAILED DESCRIPTION OF THE PREFERRED EMBODIMENTS

Figure 1:
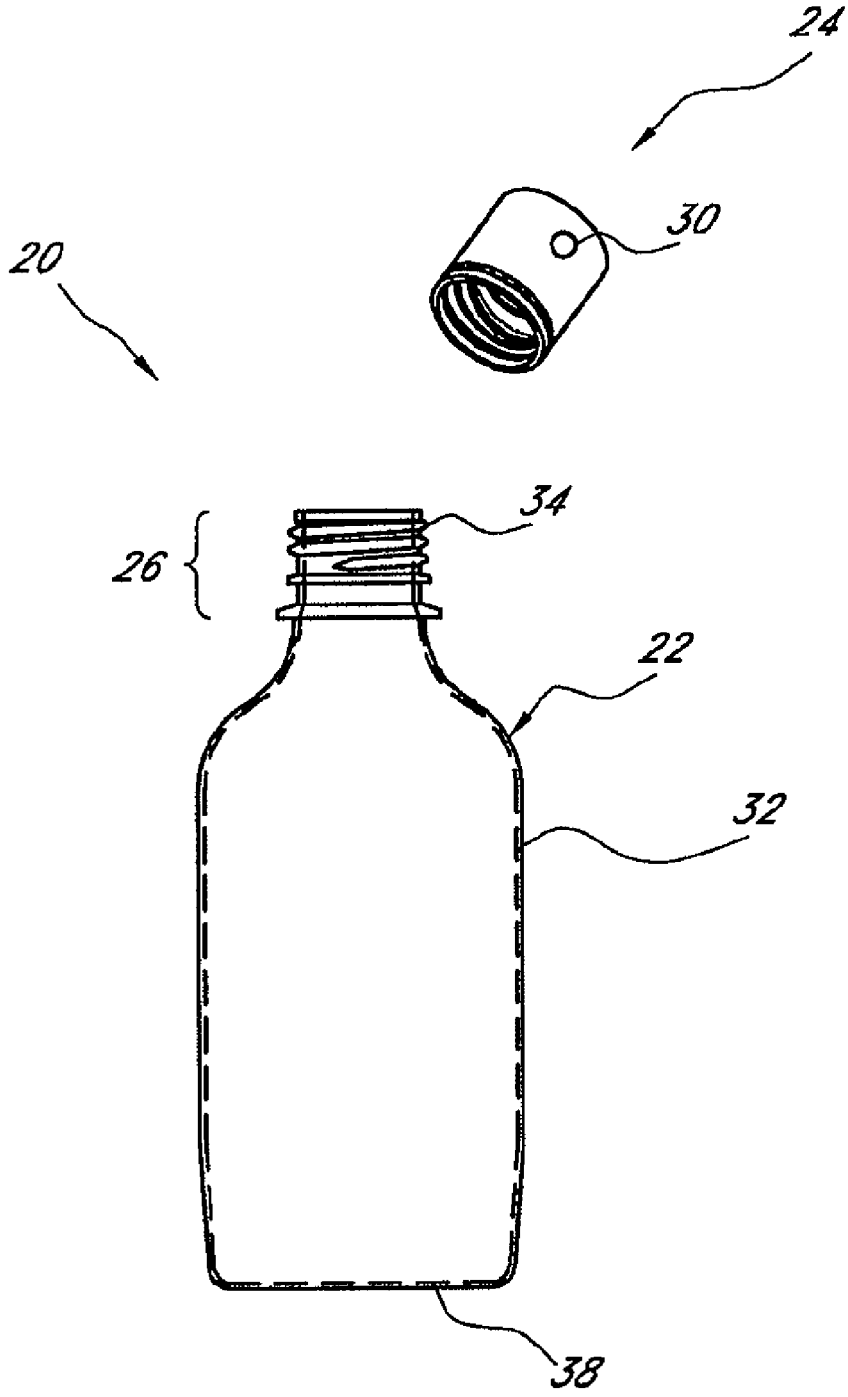
FIG. 1 is a side view of one preferred embodiment of packaging including a container and a closure having a timing mechanism.

FIG. 1 illustrates a packaging system 20 comprising a container 22, a closure 24, and a timing mechanism 30. The container 22 contains a neck finish 26 that is configured to receive the closure 24. The container 22 is designed to hold foodstuffs, oral care products (e.g., dental hygiene products), or medicants. The dental hygiene products is a broad term that can include such products as mouthwash, plague removing agents, anti-cavity solutions (e.g., solutions comprising Fluoride). Mouthwash can be rinsing solutions, antibacterial agents, liquids or other wash suitable for treating a person's mouth. For the sake of convenience, the packaging system 20 is described containing dental hygiene products in the form of mouthwash. The timing mechanism 30 that can provide feedback to a person that uses the mouthwash from the container 22. The timing mechanism 30 can inform a person how long they have rinsed their mouth with mouthwash. Each time a person uses mouthwash from the container, they can rely on the timing mechanism 30 to determine a suitable period of time for rinsing with the mouthwash. For example, the timing mechanism 30 can alert the user after the person has rinsed with mouth wash for about 30 seconds.

The container 22 has the neck portion 26 connected to a body portion 32. The neck portion 26 in the illustrated embodiment is further characterized by the presence of threads 34, which are suitable for fastening a cap or closure member (e.g., closure 24) to the container 22. Alternatively, the neck portion 26 may not be configured to engage a closure or may have structures or devices other than threads to engage a closure. The body portion 32 can have any of a variety of shapes but in the illustrated embodiment is an elongated and generally cylindrically-shaped structure extending downwardly from the neck portion 26 and culminating in a base 38. The container 22 can comprise glass, polymers, and/or other suitable materials for forming a container for holding liquids. For example, the container 22 can comprise a thermoplastic or polymeric material, such as ethylene acrylic acid, ethylene vinyl acetate, linear low density polyethylene, polyethylene terephtalate glycol, poly(hydroxyamino ethers), polyethylene terephtalate, polyethylene, polypropylene, polystyrene , cellulose material, mixtures thereof, and the like. The container 22 can be made by a thermoforming process, such as a stretch blow molding process or extrusion blow molding process. The container 22 can be transparent so that a person can see the contents in the container 22. Advantageously, a person can see the amount of liquid held within the container 22. However, the container 22 can also be semitransparent or opaque.

As used herein, the term "container" is a broad term and is used in accordance with its ordinary meaning and may include, without limitation a bottle (typically of glass and/or plastic having a comparatively narrow neck or mouth), a bottle-shaped container for storing fluid (preferably a liquid), etc. The terms "container" and "bottle" may be used interchangeably herein.

Figure 2:
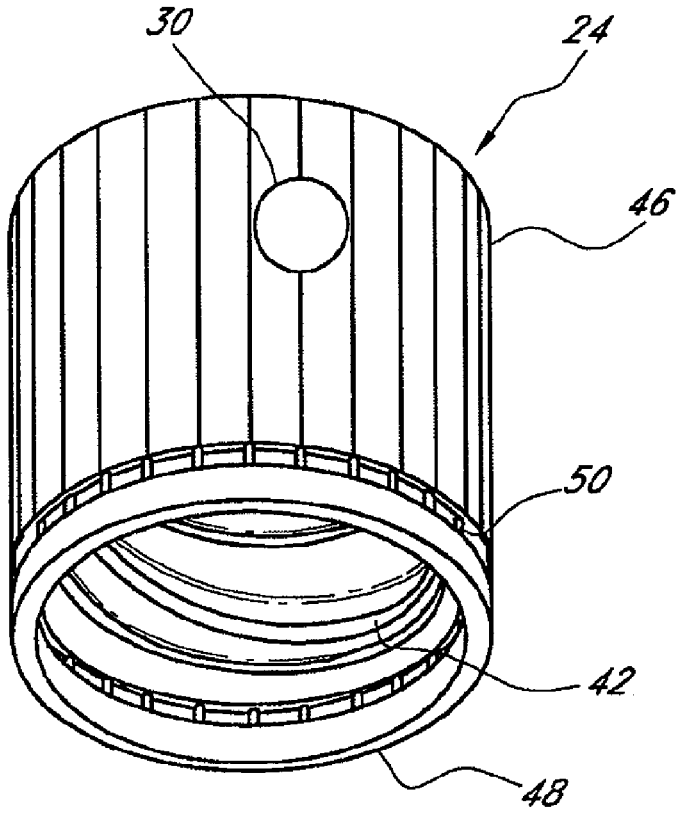
FIG. 2 is a perspective view of a closure having a timing mechanism.

With respect to FIGS. 1 and 2, the closure 24 is a screw cap with internal threads 42 (FIG. 2) configured to mate with the threads 34 of a neck portion 26, so that the closure 24 can be removably coupled to the container 22. The closure 24 includes a main body 46 and an optional tamper evidence structure or anti-tamper structure, such as a band 48 coupled to the body 46 by one or more connectors 50. The connectors 50 can be sized and adapted so that when the closure 24 is removed from the container 22, the connectors 50 will break, thus separating the body 46 and the band 48 indicating that the closure 24 has been removed from the associated container. Although not illustrated, other types of tamper evidence structures (e.g., tamper proof seals or puncture seals) can be employed.

As used herein, the term "closure" is a broad term and is used in accordance with its ordinary meaning and may include, without limitation, a cap (including snap cap, flip cap, bottle cap, threaded bottle cap, a lid (e.g., a lid for a cup), snap closure, and/or the like. Generally, the closures can have one or more features that provide further advantages. Some closures can have one or more of the following: tamper evident feature, tamper resistant feature, sealing enhancer, gripping structures to facilitate removal/placement of the closure, non-spill feature, and combinations thereof. The illustrated closure 24 comprises a single timing mechanism 30. In other embodiments, the closure 24 can comprise a plurality of timing mechanisms. Closures can have a one-piece or multipiece construction and may be configured for permanently or temporarily coupling to a container.

Figure 3:
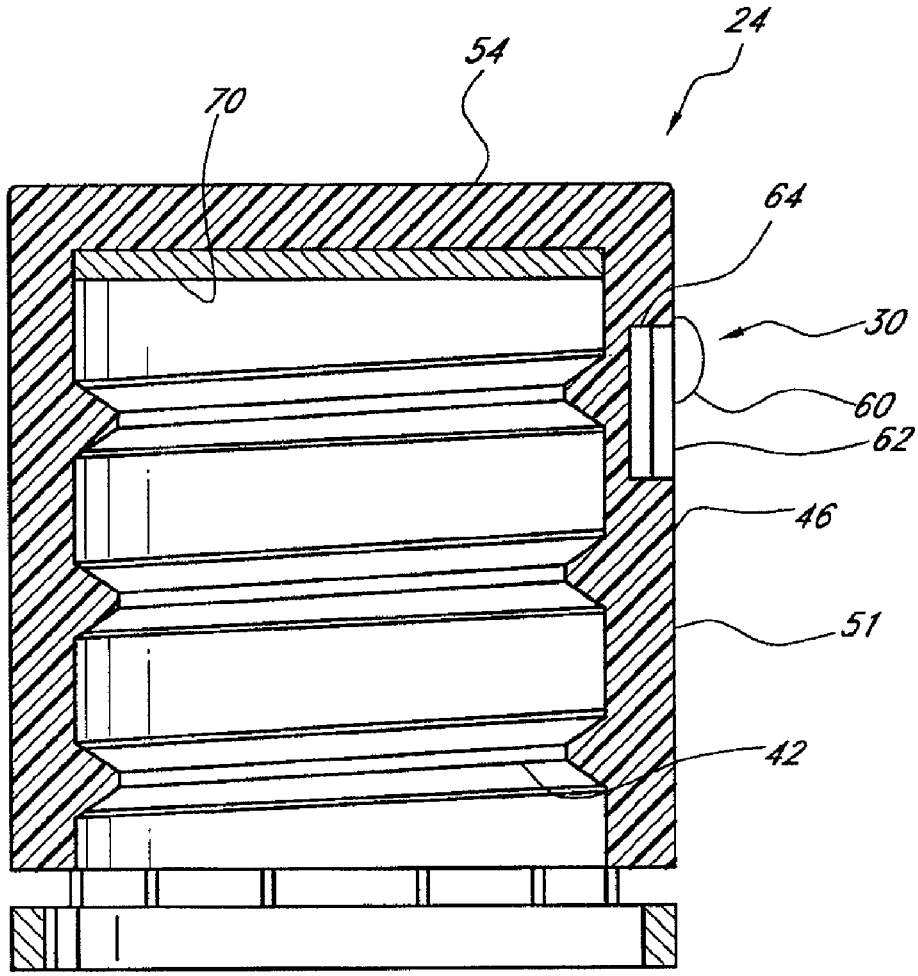
FIG. 3 is a cross-sectional view of the closure of FIG. 2.

As shown in FIG. 3, the closure 24 has the timing mechanism 30 attached to the main body 46 of the closure 24. The illustrated timing mechanism 30 is at least partially embedded in the body 46 and is positioned along the cylindrical wall 51 of the closure 24. Preferably, at least a portion of the timing mechanism 30 is visibly exposed by the main body 46. However, the timing mechanism 30 can be at other suitable positions along the closure 24. For example, the timing mechanism 30 can be attached to, embedded within and/or positioned within a cavity within a top 54 of the closure 24. The timing mechanism 30 can be coupled to the closure 24 by using adhesives, fasteners, mounting structures, or any other suitable manner for attaching the timing mechanism 30 to the closure 24.

The timing mechanism 30 preferably includes one or more of the following: a sensory device 60, a timing device 62, and a power supply 64. The sensory device 60 preferably generates or provides an output that can be perceived by a person. For example, the sensory device 60 can comprise one or more lights, vibrators (e.g., a rotating unbalanced mass), auditory systems (e.g., a speaker), articulating device (e.g., an articulating arm), visual display, and combinations thereof. The timing mechanism 30 can operate at a desired time to alert a person that a certain amount of time has passed. A person can thus use the timing mechanism 30 to determine a suitable period of time to rinse with mouthwash, for example. In some embodiments, the timing mechanism 30 comprises an hourglass, mechanical or electric timer, or other suitable time keeping device. In certain embodiments, the sensory device 60 is embedded and/or positioned within a cavity in the closure 24. In such embodiments, the closure 24 can be formed, at least in part, from a transparent material (e.g., transparent plastic).

The power supply 64 can provide power to one or more components of the timing mechanism 30. The illustrated power supply 64 of FIG. 3 provides power both the sensory device 60 and the timing device 62. The power supply 64 can comprise one or more batteries or any energy source device for powering at least one component of the timing mechanism 30. Of course, it should be appreciated that not all embodiments of the timing mechanism 30 require a power supply 64 (e.g., certain mechanical timing devices).

In the illustrated embodiment, the sensory device 60 is a light that is powered by the power supply 64 in the form of a battery. The light 60 can comprise one or more light emitting diodes (LED), or other suitable illumination device for catching the attention of a user. The timing mechanism 30 can be configured to flash (preferably repeatedly) or provide continuous illumination to effectively alert a person. In one embodiment, a plurality of lights of multiple colors are flashed on and off in a patterned sequence during the desired time period.

The timing device 62 can comprise a clock, timer (including a mechanical or electric timer), hourglass, and/or other timing device. The timing mechanism 30 can have a user controlled input such that the user can start the timing device 62. After a predetermined length of time, the timing device 62 can cause activation of the sensory device 60 to indicate to the user that they have rinsed with mouthwash for a suitable length of time. Then the timing device can be reset. The sensory device 60 can be actuated to start the timing processes. In the illustrated embodiment, a user can depress the sensory device 60, which is movably relative to the closure 24.

Once the sensory device 60 is depressed, the timing mechanism 62 starts measuring time. After a predetermined length of time is reached, the timing mechanism 62 activates the sensory device 60 which preferably alerts a user. Preferably, the length of time measured by the timer 62 generally corresponds to a desirable rinse time. For example, a desired rinse time may be 10 seconds, 15 seconds, 20 seconds, 25 seconds, 30 seconds, 35 seconds, 40 seconds, 50 seconds and ranges encompassing such lengths of time. In one embodiment, the desired rinse time is about 30 seconds. In some embodiments, the time measured by the timer 62 includes a length of time to operate or open the closure of the container. For example, the timer 62 can run for 35 seconds, which includes 30 seconds for rinsing and 5 seconds to operate or open (e.g., to push or close the cap) the closure, and then alerts the user. Of course, the desired rinse time may depend upon the type of mouthwash contained within the container 22. Additionally, the timing device 62 can have a controller so that the user can adjust the amount of time that passes before the sensory device 60 is activated. Some mouthwashes may effectively destroy microorganisms faster then other mouthwashes. The controller can be used to select the desired rinse time measured by the timing mechanism 30. Thus, the timing mechanism device 62 is configured to notify the user after a preset period of time.

The timing device 62 can be electronically driven as in the illustrated embodiment. However, in other embodiments, the timing device 62 can be mechanically driven. For example, the timing device 62 may comprise a windup clock, motion powered timing device, or other suitable mechanical device.

The timing mechanism 30 can start measuring time before the closure is removed, during closure removal, or after closure removal. For example, the timing mechanism 30 can start measuring time as the packaging system 20 is moved, which may be before the closure 24 is removed. The timing mechanism 30 can have a motion sensor in communication with the timing device 62. When the user moves the packaging system 20, the motion sensor sends a signal to the timing device 62 so that the timing device 62 starts the timing process. In another embodiment, the timing mechanism starts measuring time when the closure 24 is removed from the container 22. In the illustrated embodiment, when the closure 24 is rotated to remove the closure 24 from the container 22, the timing mechanism 30 is activated so that it starts measuring a period of time. After a period of time is reached, the timing mechanism 30 can indicate that the desired length of time has been reached to the user. The length of time measured by the timing mechanism 30 can include an average time to remove the closure, average time to place the mouthwash within the user's mouth, and/or other time periods associated with using mouthwash.

In some embodiments, the timing mechanism 30 can have a switch or tab that a user can actuate to start the timing process. The switch can be activated at any time, such as before, during, or after the closure 24 is removed from the container 22. For example, the timing mechanism 30 can be preset so that the user can activate the switch contemporaneously with the user rinsing with mouthwash. If the desired rinse time for a mouthwash is 30 seconds, the user can start rinsing with mouthwash and activate the mechanism 30 which measures the length of time, preferably measuring 30 seconds or more. After the timing mechanism 30 measures the predetermined length of time, the sensory device 60 can inform the user that they have rinsed with mouthwash for a suitable length of time.

In some embodiments, the timing mechanism 30 can be activated as the closure 24 is removed. For example, the closure 24 can have a liner 70 (FIG. 3) that is configured to engage the lip of the container 22. When the liner 70 is moved relative to container 22, the timing mechanism 30 can receive a signal indicating the user is removing the closure 24. The timing mechanism 30 can start the timing process. The liner 70 can have one or more pressure sensitive sensors (e.g., a contact sensor) that can engage the container 22. In some embodiments, the closure 24 is a closure with a child safety design. The closure 24 may have to be pressed downwardly towards the container 22 and then twisted for removal. When the closure 24 is pressed against the container 22, the liner 70 can send a signal to the timing device 62.

The timing mechanism 30 can be set by the user to remind the user that it is time to rinse with mouthwash. The timing mechanism 30 can be set to alert the user after a predetermined period of time, at a particular time, and the like. For example, the timing mechanism 30 can be set to alert the user at a particular time each day. In some embodiments, the timing mechanism 30 is set to alert a user after a period of time has passed. The timing mechanism 30 can have a user controlled input such that the user can set the mechanism 30 to remind the user to use the mouthwash.

Figure 5:
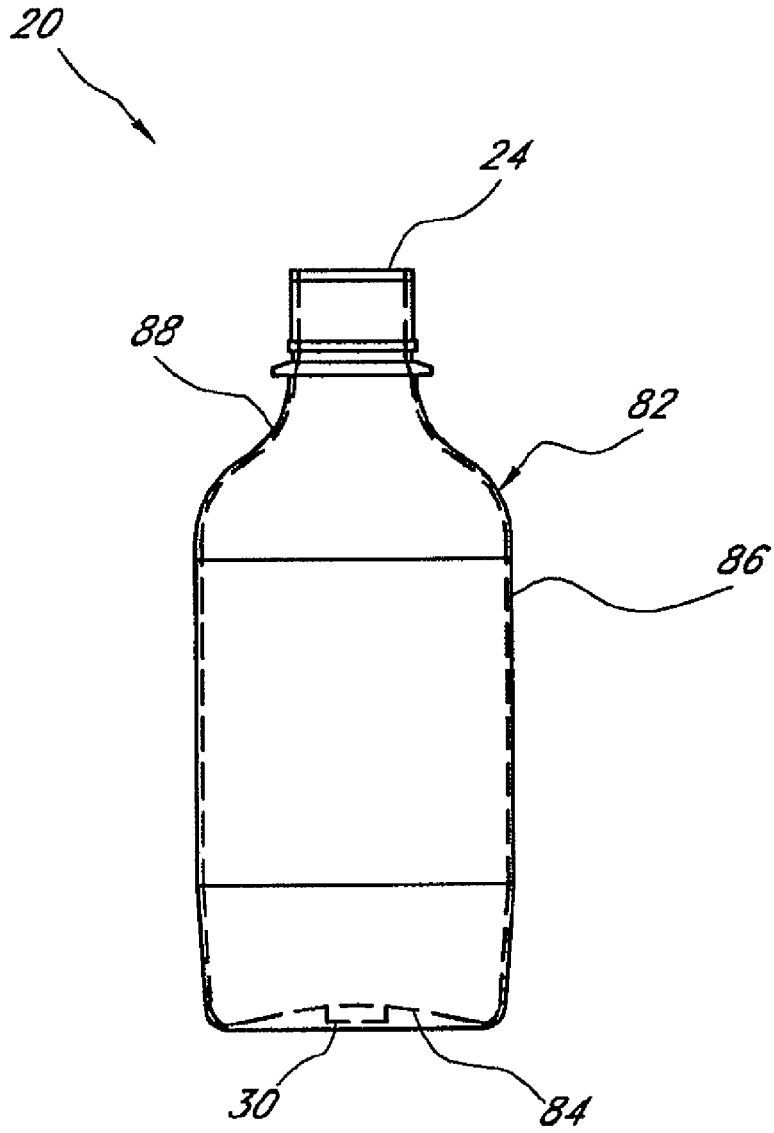
FIG. 5 is a side view of a container having a timing mechanism.

The timing mechanism 30 can be attached to any suitable part of the packaging. As shown in FIG. 5, the timing mechanism 30 is attached to the outer surface of the container 82. The illustrated timing mechanism 30 is attached to the curved bottom surface 84 of the container 82. The surface 84 forms a recessed region sized and configured for receiving the timing mechanism 30. Preferably, the sensory device of the timing mechanism 30 is positioned so that it can alert the user after a preset period of time has passed. The timing mechanism 30 can be positioned at other suitable locations along the container 82. For example, the timing mechanism 30 can be embedded in the sidewall 86 of the container 82. In other embodiments, the timing mechanism 30 is positioned along the neck 88 of the container 82. The timing mechanism 30 can be positioned (e.g., adhered to) the interior surface of the container 82. Alternatively, the timing mechanism 30 can be adhered to the outer surface (including a label) of the container 82. Thus, the timing mechanism 30 can be disposed on the interior portion of the container, embedded in the wall 82, positioned on the exterior of the container 82 or positioned at any other desired position.

Although the described embodiment primarily consists of a single timing mechanism 30, a plurality of timing mechanisms can be used. For example, a closure and an associated container each can have a timing mechanism. Additionally, a closure or a container may comprise a plurality of timing mechanisms.

In operation, a person can open the packaging 20 by removing the closure 24 from the container 22. The contents of the container 22, preferably mouthwash, can be pored into a person's mouth. The timing mechanism 30 can alert the person after a suitable amount of time has passed for rinsing with the mouth wash. After the person is alerted by the timing mechanism 30, the person can spit out the mouthwash. These acts can be repeated until all of the mouthwash is used. Because the timing mechanism 30 is conveniently carried the container or closure, a person does not have to use a separate time keeping device.

Figure 6A:
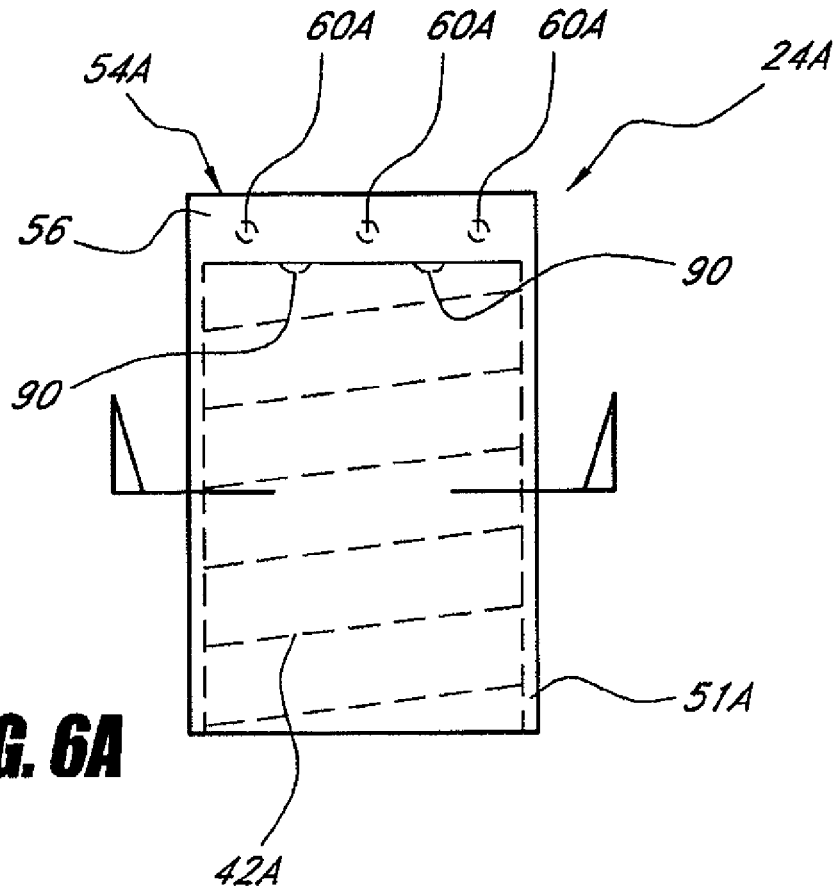
FIG. 6A is a side view of a closure having a timing mechanism.
Figure 6B:
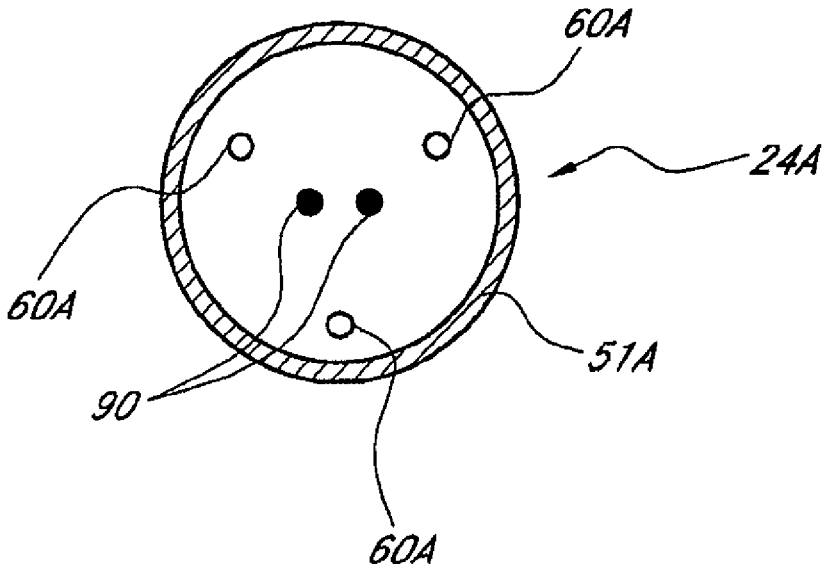
FIG. 6B is a cross-sectional view of the closure of FIG. 6A.

FIGS. 6A and 6B illustrate an embodiment of an enclosure 24A in which the sensory devices 60A are embedded and/or positioned within the top wall 56 of the closure 24A. In the illustrated embodiment, the sensory devices 60A can be lights that are configured to illuminate when the timing mechanism is activated. To enhance the decorative and perceptive effect, the lights can flash and/or illuminate in different colors. As shown in FIG. 6B, the closure 24A has a total of 3 sensory devices 60A arranged in a generally triangular pattern. Those of skill in the art will appreciate, however, that more or fewer sensory devices 60A may be used. In addition, the size, location, arrangement and other features of the sensory devices 60A may be different than depicted in FIGS. 6A and 6B.

The closure 24A is preferably constructed of a translucent material (e.g., translucent plastic) to permit the sensory devices 60A to be easily perceived by a user. Although the closure shown in FIG. 6A has a cylindrical shape, any suitable shape may be alternatively used. Further, as discussed with respect to the embodiments illustrated in FIGS. 1-3, the cylindrical wall 51 A of the closure 24A can have internal threads 42A to match corresponding threads situated on the outside of a bottle or other container. For safety, the closure 24A may additionally comprise an tamper evidence or anti-tamper structure.

With continued reference to FIGS. 6A and 6B, in the illustrated embodiment, the interior portion of the closed, top portion 54A of the closure 24A includes a pair of sensors 90 that are exposed to the interior of the closure 24A and are configured to activate one or more timing mechanisms included on and/or within the closure 24A. In one embodiment, the sensors 90 comprise exposed contact points that are configured to activate the timing mechanism when touched or contacted by a water or another substance conductive substance (e.g., a mouthwash). Thus, in one embodiment, the conductive substance is poured into the closure 24A and contacts the sensors 90. The sensors 90 are part of an electrical circuit, which when completed activates the timing mechanism and sensory devices 60A. In this embodiment, the conductive substance completes a circuit between the two sensors 90 to activate the timing mechanism. After the circuit is completed and the timing mechanism activated, the user can then use the closure 24 as a cup to place the liquid into their mouth. The sensory devices 60A operate for a desired time period to indicate the desired time the liquid should be used.

Thus, in the illustrated embodiment, the sensors 90 comprises 2 electrodes on the interior of the closure 24A. Therefore, when a liquid capable of conducting electricity is placed within the closure 24A, an electrical current between the electrodes is completed and the timing mechanism may commence. However, those of skill in the art will recognize that other types of sensors 90 may be used in lieu of or in addition to the basic contact sensor 90 described above. For example, the sensor 90 may comprise of other types of sensors 90 include pressure sensors, temperature sensors and the like.

Figure 4:
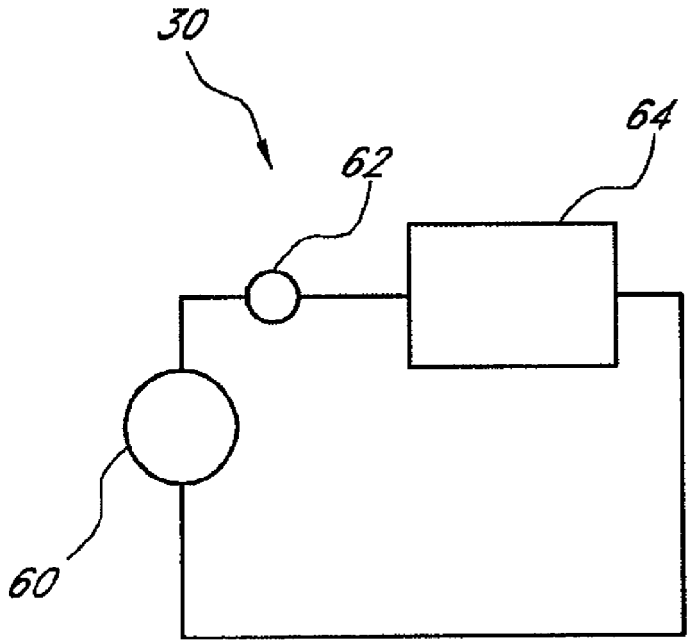
FIG. 4 is a block diagram of a timing mechanism.

Although not shown in FIGS. 6A and 6B, a timing device, a power supply (e.g., battery) and other components of the timing mechanism (see e.g., FIG. 4) can be positioned and/or embedded within the wall of the closure 24A. Once activated by the timing mechanism, the lights or other sensory devices 60A operate for a designated amount of time. Thus, a user is alerted that a particular time period (e.g., the recommended time period for rinsing with mouthwash) has elapsed.

The various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments disclosed herein. Similarly, the various features and steps discussed above, as well as other known equivalents for each such feature or step, can be mixed and matched by one of ordinary skill in this art to perform methods in accordance with principles described herein. Additionally, the methods which is described and illustrated herein is not limited to the exact sequence of acts described, nor is it necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein

I claim:

1. A packaging system, comprising:

a bottle holding a mouthwash with antibacterial agents;

a closure configured to be removably coupled to the bottle, the bottle defining an opening when the closure is removed from the bottle;

a timing mechanism coupled to the closure, the timing mechanism including an electrical sensory device and a timer, the timer configured to operate during a period of time and the sensory device configured to provide an audible or visual output during or after the period of time; and a sensor positioned within the closure and configured to detect the presence of a liquid within the closure, wherein the timing mechanism is configured to activate when the closure is removed from the bottle and the sensor detects a liquid within the closure.

2. The packaging system of claim 1, wherein the sensory device comprises at least one selected from the following: light, vibrator, and auditory device.

3. The packaging system of claim 1, further comprising means for modifying the period of time.

4. The packaging system of claim 1, wherein said period of time is about 30 seconds.

5. The packaging system of claim 1, wherein the sensory device is positioned within a wall of the closure.

6. The packaging system of claim 1, wherein the sensor is configured to detect the presence of a liquid within the closure when a liquid physically contacts the sensor.

7. A packaging system, comprising:

a bottle;

a closure configured to be removably coupled to the bottle, the bottle defining an opening when the closure is removed from the bottle, the closure further defining a space into which contents from the bottle can be poured; and a timing mechanism positioned within the closure the timing mechanism including a sensory device, a timer, and means for activating the timer and sensory device when the contents from the bottle are poured into the closure wherein the sensory device is a light and the light is configured to flash during a duration determined by the timer and the light begins to flash when the means for activating the timer and sensory device contacts the contents.

8. The packaging system of claim 7, wherein the contents is a mouthwash with antibacterial agents.

9. A method of using a dental hygiene product, the method comprising:

removing a cap from a bottle in which the dental hygiene product is stored;

pouring the dental hygiene product into the cap, the dental hygiene product activating a timing mechanism provided within or on the cap;

transferring the dental hygiene product from the cap to a user's mouth; and using the dental hygiene product for a period of time that is indicated by the timing mechanism.

10. A dental hygiene product, comprising:

a bottle having a body portion and a neck portion connected to the body portion, the body portion configured to hold a mouthwash with antibacterial agents;

a cap defining a cavity, the cap configured to be removably coupled to the neck portion of the bottle;

a timing device positioned within the cavity of the cap and configured to operate for a predetermined rinse time;

a sensory device coupled to at least one of the bottle or the cap, the sensory device providing an audible or visual output in response to a signal received from the timing device, the signal being received during or after expiration of the predetermined rinse time; and a sensor positioned within the cavity and coupled to the timing device to activate the timing device when the mouthwash contacts the sensor.

11. The dental hygiene product of claim 10, further comprising a switch coupled to the timing device to activate the timing device.

12. The dental hygiene product of claim 10, wherein the sensor comprises at least two electrodes.

13. The dental hygiene product of claim 10, wherein the visual output is a light.

14. The dental hygiene product of claim 13, wherein the light is configured to flash during or after the predetermined rinse time.

* * * * *